US012503935B2

(12) United States Patent
Zhong et al.

(10) Patent No.: US 12,503,935 B2
(45) Date of Patent: Dec. 23, 2025

(54) LIQUID-COOLED FRACTURING SYSTEM

(71) Applicant: YANTAI JEREH PETROLEUM EQUIPMENT & TECHNOLOGIES CO., LTD., Shandong (CN)

(72) Inventors: Jifeng Zhong, Shandong (CN); Liang Lv, Shandong (CN); Yipeng Wu, Shandong (CN); Xincheng Li, Shandong (CN)

(73) Assignee: Yantai Jereh Petroleum Equipment & Technologies Co., Ltd., Yantai (CN)

( * ) Notice: Subject to any disclaimer, the term of this patent is extended or adjusted under 35 U.S.C. 154(b) by 181 days.

(21) Appl. No.: 18/463,748

(22) Filed: Sep. 8, 2023

(65) Prior Publication Data

US 2024/0102359 A1 Mar. 28, 2024

(30) Foreign Application Priority Data

Sep. 26, 2022 (CN) ..... 202222542723.7

(51) Int. Cl.

| | |
|---|---|
| ***E21B 43/26*** | (2006.01) |
| ***F04B 17/03*** | (2006.01) |
| ***F04B 23/04*** | (2006.01) |
| ***F04B 49/06*** | (2006.01) |
| ***F04B 53/08*** | (2006.01) |

(52) U.S. Cl.

CPC ..... *E21B 43/2607* (2020.05); *F04B 17/03* (2013.01); *F04B 23/04* (2013.01); *F04B 49/06* (2013.01); *F04B 53/08* (2013.01); *F04B 2201/0404* (2013.01); *F04B 2203/0205* (2013.01)

(58) Field of Classification Search

CPC ..... E21B 43/2607; F04B 17/03; F04B 23/04; F04B 49/06; F04B 53/08; F04B 2201/0404; F04B 2203/0205

See application file for complete search history.

(56) References Cited

U.S. PATENT DOCUMENTS 8,529,217 B2 * 9/2013 Alfes ..... F04D 29/584 417/372
2024/0344427 A9 * 10/2024 Sharp ..... F01P 3/18

FOREIGN PATENT DOCUMENTS

CA 3190042 C * 8/2023 ..... E21B 33/13
CN 205936563 U * 2/2017
CN 216110670 U * 3/2022

OTHER PUBLICATIONS

Translation of CA 3190042. (Year: 2015).*
Translation of CN 205936563 (Year: 2016).*
Translation of CN 16110670 (Year: 2022).*

* cited by examiner

*Primary Examiner* — Charles G Freay
(74) *Attorney, Agent, or Firm* — Sheppard Mullin Richter & Hampton LLP

(57) ABSTRACT

A liquid-cooling fracturing system includes a fracturing device; a power device connected to the fracturing device through a transmission device and configured to provide power for the fracturing device; a cooling medium storage device configured to store a cooling medium for cooling the power device; and a first heat exchange device, the first heat exchange device using cooling liquid to exchange heat with the cooling medium to cool the cooling medium.

14 Claims, 8 Drawing Sheets

LIQUID-COOLED FRACTURING SYSTEM

CROSS-REFERENCE TO RELATED APPLICATIONS

This application claims priority to Chinese patent application No. 202222542723.7 filed on Sep. 26, 2022. The disclosure of the above application is incorporated herein by reference in its entirety.

TECHNICAL FIELD

This application relates to a fracturing system, and in particular relates to a liquid-cooling fracturing system using cooling liquid for cooling.

BACKGROUND

In the field of oil and gas exploitation, fracturing operation refers to a technology that uses high-pressure fracturing fluid to form fractures in oil and gas reservoirs during oil or gas production. Through the fracturing operation, the oil and gas reservoirs may form fractures, which can allow the underground flow of oil or natural gas and increase the production of oil wells. Therefore, the fracturing operation is a main way to increase production in oil and gas field exploitation. Equipment capable of performing the fracturing operation is called fracturing equipment. In particular, the pumping process of unconventional oil and gas resources requires the fracturing equipment.

In oil and gas exploitation, with increased formation depth, pressure, etc., the scale of fracturing construction continues to increase, and the demand for single-machine power of the fracturing equipment is getting higher and higher. In summer, the high temperature will affect the efficiency of a cooling system of the fracturing equipment. And once a high temperature alarm occurs, it affects the normal operation, resulting in the need to reduce the power of the equipment to avoid overheating. On the other hand, a heat exchanger of traditional fracturing equipment uses liquid and air, or air and air for heat exchange, which has low heat exchange efficiency and usually requires a large-size fan or a special draught fan. Hot air has an impact on the surrounding environment, and meanwhile, noise is increased by the fan and the draught fan.

For electric drive fracturing equipment, cooling by the fan easily results in the accumulation of dust and particles in a motor, which has some adverse effects on the service life of the motor and may lead to an increased failure rate.

The motor in China's utility model patent CN216110670U is a water-cooled motor, but it does not get rid of the use of a fan. It uses liquid to transfer heat of the motor to a heat exchanger, and the heat exchanger transfers heat of the liquid to the air, so as to realize heat exchange, which still has the problems of noise and low heat exchange efficiency.

Especially in mines, offshore platforms, and fracturing stimulation cabins, due to the limited space in these regions, the ventilation is less and the impact of the noise is more obvious, so the traditional heat exchange method cannot meet heat dissipation requirements of the equipment.

SUMMARY

In order to solve the above problems of low heat dissipation efficiency and noise in fracturing equipment in the prior art, several embodiments are provided.

A liquid-cooling fracturing system of this application includes: a fracturing device; a power device, the power device being connected to the fracturing device through a transmission device and configured to provide power for the fracturing device; a cooling medium storage device, configured to store a cooling medium for cooling the power device; and a first heat exchange device, the first heat exchange device using cooling liquid to exchange heat with the cooling medium to cool the cooling medium.

Furthermore, the liquid-cooling fracturing system further includes: a lubricating system, the lubricating system including a lubricating medium storage device, the lubricating medium storage device being configured to store a lubricating medium used for lubricating the fracturing device; and a second heat exchange device, the second heat exchange device using the cooling liquid to exchange heat with the lubricating medium, to cool the lubricating medium.

Furthermore, the liquid-cooling fracturing system further includes: a first pumping device, configured to circulate the cooling medium between the cooling medium storage device, the power device and the first heat exchange device; and a second pumping device, configured to circulate the lubricating medium between the lubricating medium storage device, the second heat exchange device and the fracturing device.

Furthermore, the liquid-cooling fracturing system further includes: a cooling liquid source, configured to provide the cooling liquid; and at least one third pumping device, configured to direct the cooling liquid to flow from the cooling liquid source into the first heat exchange device and/or the second heat exchange device, to exchange heat with the cooling medium and/or the lubricating medium at the first heat exchange device and/or the second heat exchange device, and return the cooling liquid to the cooling liquid source after heat exchange.

Furthermore, the liquid-cooling fracturing system further includes: a first flow pipeline, through which the cooling medium circulates between the cooling medium storage device, the power device and the first heat exchange device; a second flow pipeline, through which the lubricating medium circulates between the lubricating medium storage device, the second heat exchange device and the fracturing device; and a third flow pipeline, through which the cooling liquid flows from the cooling liquid source into the first and second heat exchange devices and returns to the cooling liquid source after heat exchange.

Furthermore, the cooling liquid has heat exchange capacity.

Furthermore, the cooling liquid source is a natural or man-made container storing the cooling liquid, where the amount of the cooling liquid in the cooling liquid source is greater than the amount of the cooling liquid for cooling the cooling medium and the lubricating medium.

Furthermore, a filtering device is disposed on an outlet pipeline of the lubricating medium storage device, to filter out solid impurities in the lubricating medium.

Furthermore, one or more flow regulating valves are disposed on cooling liquid inlet pipelines or cooling liquid outlet pipelines of the first and second heat exchange devices, to regulate flow of the cooling liquid flowing through the first and second heat exchange devices.

Furthermore, one or more pressure sensors are disposed on outlet pipelines of the first pumping device and the second pumping device to measure pressures in the pipelines, and one or more safety valves are disposed on the outlet pipelines of the first pumping device and the second pumping device, the one or more safety valve being configured to regulate the pressure in the pipeline based on a measurement result of the pressure sensor.

Furthermore, the liquid-cooling fracturing system further includes one or more temperature sensors, the one or more temperature sensors being disposed on inlet pipelines or outlet pipelines of the first pumping device, the second pumping device and the third pumping device respectively, to measure temperatures of liquid flowing in the pipelines.

Furthermore, a pressure sensor is disposed on an outlet pipeline of the third pumping device to measure a pressure in the outlet pipeline of the third pumping device.

Furthermore, a flowmeter is disposed on an outlet pipeline of the third pumping device to measure flow of liquid flowing in the outlet pipeline of the third pumping device.

Furthermore, the liquid-cooling fracturing system further includes a control system, the control system being capable of automatically controlling the flow of each pumping device according to the temperature measured by the temperature sensor, and/or the control system being capable of automatically controlling the third pumping device to keep the pressure measured by the pressure sensor constant, and/or the control system being capable of automatically controlling the third pumping device to keep the flow measured by the flowmeter constant.

Furthermore, a thermostat is disposed on an outlet pipeline of the second pumping device.

Furthermore, the liquid-cooling fracturing system includes one third pumping device, the one third pumping device being configured to correspond to one piece of liquid-cooling fracturing equipment composed of the fracturing device, the power device, the cooling medium storage device, the lubricating medium storage device, the first and second heat exchange devices, the first pumping device and the second pumping device.

Furthermore, the liquid-cooling fracturing system includes a single third pumping device, the single third pumping device being configured to correspond to a plurality of pieces of liquid-cooling fracturing equipment composed of the fracturing devices, the power devices, the cooling medium storage devices, the lubricating medium storage devices, the first and second heat exchange devices, the first pumping devices and the second pumping devices.

Furthermore, the at least one third pumping device has two third pumping devices, where one third pumping device is configured to provide cooling for lubricating systems of the plurality of fracturing devices of the plurality of pieces of liquid-cooling fracturing equipment, and the other third pumping device is configured to provide cooling for the plurality of power devices of the plurality of pieces of liquid-cooling fracturing equipment, where parameters of each third pumping device can be respectively set according to differences of the types of cooled components.

Furthermore, the fracturing device, the power device, the cooling medium storage device, the lubricating medium storage device, the first pumping device and the second pumping device are configured to form liquid-cooling fracturing equipment.

Furthermore, the liquid-cooling fracturing equipment is integrated with the heat exchange devices, or the liquid-cooling fracturing equipment is integrated with the heat exchange devices and the third pumping device.

DETAILED DESCRIPTION

This application will now be described in detail with reference to the drawings and in conjunction with embodiments.

Embodiment 1

Figure 1:
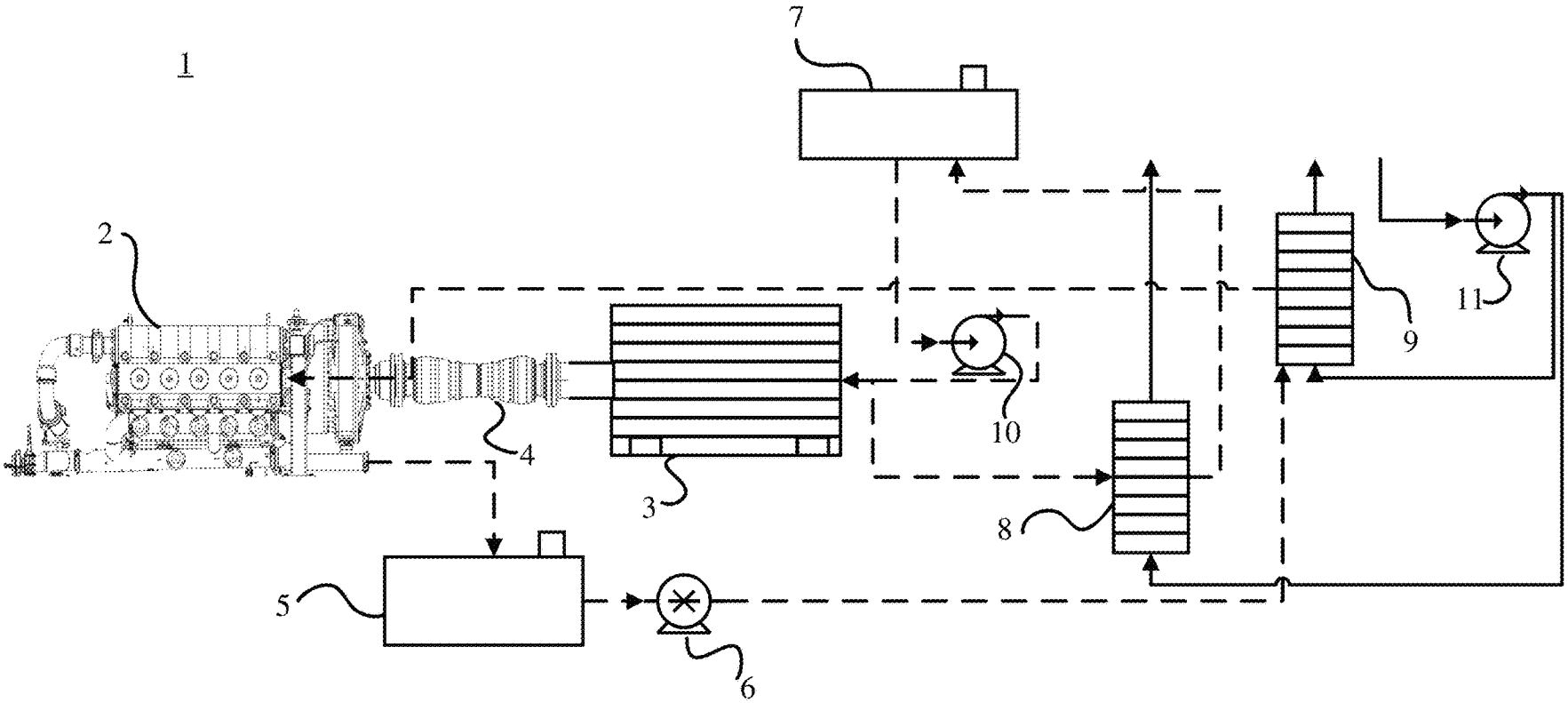
FIG. 1 is a schematic diagram illustrating a liquid-cooling fracturing system according to Embodiment 1 of this application.

FIG. 1 is a schematic diagram illustrating a liquid-cooling fracturing system according to Embodiment 1 of this application. With reference to FIG. 1, a liquid-cooling fracturing system 1 of Embodiment 1 includes a fracturing device 2; a power device 3, the power device 3 being connected to the fracturing device 2 through a transmission device 4 and configured to provide power for the fracturing device 2; a cooling medium storage device 7, configured to store a cooling medium for cooling the power device 3; and a first heat exchange device 8, the first heat exchange device 8 using cooling liquid to exchange heat with the cooling medium that is returned from the power device 3, to cool the cooling medium.

The fracturing device 2 may be a plunger pump, the power device 3 may be a motor, and the transmission device 4 may be a coupling. The cooling medium may be a motor cooling medium, such as water, deionized water, glycol solution, or oil. The cooling medium storage device 7 may be a motor cooling medium box. The first heat exchange device 8 may be a heat exchanger, such as a plate heat exchanger and a shell-and-tube heat exchanger. The cooling liquid may be a liquid with heat exchange capacity, such as water, a glycol solution, or seawater. In this Embodiment 1, the fracturing device 2 may be configured to perform fracturing operation. The power device 3 is connected to the fracturing device 2 through the transmission device 4, such as a transmission shaft, so as to provide power for the fracturing device 2. The power device 3, such as a motor, continuously generates heat during operation. In order to prevent the normal operation of the power device 3 from being affected by the generated heat, it is necessary to use a normal-temperature or cold cooling medium stored in the cooling medium storage device 7 to cool the power device 3 to such that the power device 3 may operate normally. Therefore, the normal-temperature or cold cooling medium stored in the cooling medium storage device 7 needs to enter the power device 3 to exchange heat with the power device 3, and the cooling medium that becomes warm after heat exchange enters the first heat exchange device 8 to exchange heat with the cooling liquid therein and become a low-temperature cooling medium again, and then returns to the cooling medium storage device 7 for recycling. It can be seen that in Embodiment 1, the cooling of the power device 3 is realized through heat exchange of the cooling medium and the cooling liquid in the first heat exchange device 8. That is, the cooling of the power device 3 is realized through heat exchange between two liquids. Compared with the cooling realized through heat exchange between liquid and air in the prior art, heat exchange in Embodiment 1 has higher efficiency.

In some embodiments, the liquid-cooling fracturing system 1 of Embodiment 1 may further include a lubricating system, the lubricating system including a lubricating medium storage device 5, the lubricating medium storage device 5 being configured to store a lubricating medium used for lubricating the fracturing device 2; and a second heat exchange device 9, the second heat exchange device 9 using the cooling liquid to exchange heat with the lubricating medium that lubricates the fracturing device 2 to cool the lubricating medium.

The lubricating medium may be plunger pump lubricating oil, such as gear oil or machine oil. The lubricating medium storage device 5 may be a lubricating oil box, and like the first heat exchange device 8, the second heat exchange device 9 may be a heat exchanger, such as a plate heat exchanger and a shell-and-tube heat exchanger. In this Embodiment 1, the lubricating medium may enter the fracturing device 2 to provide lubrication for the fracturing device 2. The fracturing device 2 will generate heat during operation, and the temperature of the lubricating medium entering the fracturing device 2 may increase accordingly due to the temperature increase of the fracturing device 2. In this case, the high-temperature lubricating medium flowing out of the fracturing device 2 may enter the second heat exchange device 9 to exchange heat with the cooling liquid therein to become a low-temperature lubricating medium, which then re-enters the fracturing device 2 for lubrication. Therefore, the lubricating medium can take away a part of heat of the fracturing device 2 while lubricating the fracturing device 2, so as to prevent the fracturing device 2 from becoming overheated in a working process and affecting the normal operation thereof. It is obvious that the cooling of the fracturing device 2 is realized through heat exchange of the lubricating medium and the cooling liquid in the second heat exchange device 9, that is, the cooling of the fracturing device 2 is realized through heat exchange between two liquids. Here, the cooling of the power device 3 and the fracturing device 2 can be realized simultaneously through the heat exchange between liquids, which further improves the heat exchange efficiency of the liquid-cooling fracturing system 1 of Embodiment 1. The cooling medium storage device 7 and the lubricating medium storage device 5 acting as containers usually have breathing holes.

In some embodiments, the liquid-cooling fracturing system 1 of Embodiment 1 may further include a first pumping device 10, configured to circulate the cooling medium between the cooling medium storage device 7, the power device 3 and the first heat exchange device 8; and a second pumping device 6, configured to circulate the lubricating medium between the lubricating medium storage device 5, the second heat exchange device 9 and the fracturing device 2.

The first pumping device 10 may be a motor cooling medium pump, and the second pumping device 6 may be a lubricating oil pump. Under the action of the first pumping device 10 and the second pumping device 6, the circulating flow of the cooling medium and the lubricating medium can be realized, so as to realize the circulating cooling of the power device 3 and the fracturing device 2.

In some embodiments, the liquid-cooling fracturing system 1 of Embodiment 1 may further include a cooling liquid source, configured to provide the cooling liquid; and at least one third pumping device 11, configured to direct the cooling liquid to flow from the cooling liquid source into the first heat exchange device 8 and/or the second heat exchange device 9, to exchange heat with the cooling medium and/or the lubricating medium at the first heat exchange device 8 and/or the second heat exchange device 9, and return the cooling liquid to the cooling liquid source after heat exchange.

The cooling liquid source may be a natural cooling liquid source, such as ocean, a river, a lake, a reservoir and a pool. The third pumping device 11 may be a cooling liquid pump, such as a water pump. Under the action of the third pumping device 11, the circulating flow of the cooling liquid in a loop sequentially composed of the cooling liquid source, the first and/or second heat exchange device 8, 9 and the cooling liquid source can be realized, thereby achieving the effective cooling of the cooling liquid to the cooling medium and/or the lubricating medium. In FIG. 1, although the third pumping device 11 are connected to the first and second heat exchange devices 8, 9 at the same time, the third pumping device 11 can also only be connected to one of the first and second heat exchange devices 8, 9, to provide cooling for the same. In some embodiments, a single third pumping device 11 is shown in FIG. 1, the quantity of the third pumping device 11 is not limited to one. For example, two third pumping devices may also be disposed, such that one third pumping device 11 is connected to the first heat exchange device 8, and the other third pumping device 11 is connected to the second heat exchange device 9, to provide cooling for the power device 3 and the fracturing device 2 respectively. In this case, the different third pumping devices 11 may be designed separately according to the different types of components to be cooled.

In some embodiments, the liquid-cooling fracturing system 1 of Embodiment 1 may also include a first flow pipeline (cooling medium flow pipeline), a second flow pipeline (lubricating medium flow pipeline), and a third flow pipeline (cooling liquid flow pipeline). The cooling medium circulates between the cooling medium storage device 7, the power device 3 and the first heat exchange device 8 through the first flow pipeline. The lubricating medium circulates between the lubricating medium storage device 5, the second heat exchange device 9 and the fracturing device 2 through the second flow pipeline. The cooling liquid flows from the cooling liquid source into the first and second heat exchange devices 8, 9 through the third flow pipeline and returns to the cooling liquid source after heat exchange.

Figure 8:
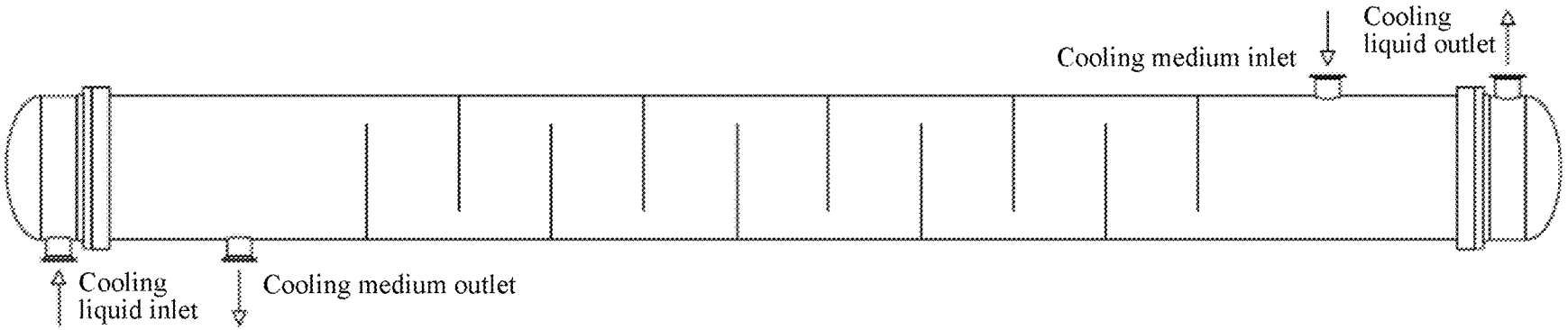
FIG. 8 is a schematic diagram illustrating a shell-and-tube heat exchanger.

The cooling medium in the cooling medium storage device 7 can flow from the cooling medium storage device 7 into the power device 3 through the cooling medium flow pipeline under the action of the first pumping device 10, and become a warm cooling medium after cooling the power device 3. The warm cooling medium flows into the first heat exchange device 8 through the cooling medium flow pipeline and exchanges heat with the cooling liquid here, so as to become a cold cooling medium again and return to the cooling medium storage device 7 through the cooling medium flow pipeline, so that the power device 3 can be circularly cooled. As mentioned above, the first and second heat exchange devices 8 and 9 may be plate heat exchangers or shell-and-tube heat exchangers, etc. With reference to FIG. 8, a schematic diagram of the shell-and-tube heat exchanger is shown.

In some embodiments, in the lubricating system of the fracturing device 2, the lubricating medium used for lubrication may rise with the operation of the fracturing device 2 due to the temperature increase of the fracturing device 2. The heated lubricating medium may flow into the lubricating medium storage device 5 through the lubricating medium flow pipeline, then flow into the second heat exchange device 9 through the lubricating medium flow pipeline under the action of the second pumping device 6, to exchange heat with the cooling liquid, so as to become a cold lubricating medium, which then flow into the fracturing device 2 through the lubricating medium flow pipeline to lubricate the fracturing device 2, so that the lubricating medium can perform cooling through the second heat exchange device 9 and lubricate the fracturing device 2 while circulated in the lubricating medium flow pipeline.

In some embodiments, the pumping device 11 may pump the cooling liquid from a cooling liquid source (not shown in the figure) to the first and second heat exchange devices 8 and 9 through the cooling liquid flow pipeline, so as to exchange heat with the warm lubricating medium or cooling medium there, and after heat exchange, the cooling liquid with increased temperature may return to the cooling liquid source (not shown), so as to be cooled again by performing heat exchange with the cooling liquid in the cooling liquid source. As mentioned above, the cooling liquid (such as water) may come from ocean, a river, a lake, a reservoir, a pool and the like in nature. Because the amount of water used for cooling fracturing equipment is very small compared to the amount of water in the ocean, river, lake, reservoir, pool, etc., the water can be easily cooled after returning to these cooling liquid sources. In some embodiments, in order to improve the heat exchange efficiency, the position where the cooling liquid enters the cooling system from the cooling liquid source is usually far away from the position where the cooling liquid returns to the cooling liquid source after leaving the cooling system, so as to avoid the situation that the cooling liquid that just has completed heat exchange in the heat exchange device circulates to the cooling system again without being fully cooled in the cooling liquid source. Although the specific designs of the cooling medium flow pipeline, the lubricating medium flow pipeline and the cooling liquid flow pipeline are not shown in FIG. 1, flow directions of the cooling medium, the lubricating medium and the cooling liquid are shown, where the cooling medium and the lubricating medium circulate in the direction of a dashed arrow and the cooling liquid circulates in the direction of a solid arrow. That is, the cooling medium flow pipeline, the lubricating medium flow pipeline and the cooling liquid flow pipeline should only be such designed that each liquid can flow in each circulating flow direction shown in FIG. 1, and are not particularly limited.

It can be seen that the technical solution in Embodiment 1 adopts a heat exchange device that uses liquid (lubricating medium or cooling medium) to exchange heat with liquid (water), so as to realize the cooling of components (plunger pump and motor) in the fracturing equipment.

In some embodiments, a filtering device may be disposed on a lubricating medium outlet pipeline of the lubricating medium storage device 5 to filter out solid impurities therein, thereby preventing damage to the second pumping device.

Additionally and alternatively, flow regulating devices may be disposed on cooling liquid inlet pipelines or cooling liquid outlet pipelines of the first and second heat exchange devices 8 and 9, to regulate flow of the cooling liquid according to different heat dissipation requirements. For example, the flow regulating device may be a flow regulating valve such as a needle valve, a butterfly valve, a ball valve and a stop valve, which can manually or automatically adjust the opening or realize closing.

In some embodiments, one or more pressure sensors may be disposed on outlet pipelines of the first pumping device 10 and the second pumping device 6 to measure pressures in each medium flow pipeline. Safety valves, such as overflow valves, may be disposed on the outlet pipelines of the first pumping device 10 and the second pumping device 6. The safety valve is configured to regulate the pressure in the pipeline based on the pressure measured by the pressure sensor.

In some embodiments, one or more temperature sensors may be disposed on inlet pipelines or outlet pipelines of the first pumping device 10 and the second pumping device 6, and temperatures measured by the temperature sensors may be transmitted to control systems for these pumping devices. The control system can display the temperature of the medium in real time and send out alarm information according to a set temperature limit. For example, when the temperature of the medium is higher than a certain set value, the control system can send out alarm information and control to increase the flow of the cooling liquid to improve the heat exchange efficiency, thereby effectively cooling the components of the fracturing equipment. In some embodiments, one or more temperature sensor may be disposed on an inlet pipeline or an outlet pipeline of the third pumping device 11, and a temperature measured by the temperature sensor(s) may also be transmitted to the control system, and the control system may determine the state of the equipment according to the inlet temperature or the outlet temperature, and appropriately adjust the flow of the cooling liquid. For example, when the temperature of the cooling liquid is high, the heat exchange efficiency is low, and it is easy to generate high temperature. In this case, the flow of the cooling liquid can be appropriately increased to improve the cooling efficiency. When the temperature of the cooling liquid is very low, it may easily cause problems such as condensation, frosting and icing. In this case, the flow of the cooling liquid can be appropriately reduced or turned off, so that the equipment can operate at suitable temperatures.

In some embodiments, a pressure sensor may be disposed on an outlet pipeline of the third pumping device 11 to measure a pressure in the pipeline. In this case, a first automatic control mode can be realized: the control system can automatically control the third pumping device 11 to keep the pressure measured by the pressure sensor constant. For example, the control system can automatically adjust a rotation speed of a pump acting as the third pumping device 11 to obtain constant pressure, thereby ensuring that the flow of fluid flowing through each heat exchange device is kept in a predetermined state. On the other hand, a flowmeter may be disposed on the outlet pipeline of the third pumping device 11 to measure the flow of the liquid flowing in the pipeline. In this case, a second automatic control mode can be realized: the control system can automatically control the third pumping device 11 to keep the flow measured by the flowmeter constant. For example, the control system can automatically adjust the rotation speed of the pump acting as the third pumping device 11 or automatically adjust the opening of a gate of an outlet of the pump, ensuring that the flow of the fluid flowing through the heat exchangers is kept in constant.

Additionally, and alternatively, one or more thermostats may be installed on an outlet pipeline of the second pumping device 6. When the temperature of the lubricating medium is relatively low, the lubricating medium bypasses the second heat exchange device 9, and is directly fed to the lubricating system of the fracturing device 2 for lubricating without performing heat exchange with the cooling liquid, for example, may refer to reference numeral 15 in FIG. 3. On the other hand, when the temperature of the lubricating medium is relatively high, the thermostat is opened gradually, the amount of the lubricating medium entering the second heat exchange device 9 is increased gradually, thereby improving the heat exchange amount and ensuring that the temperature of the lubricating medium is below the limit.

Embodiment 2

Figure 2:
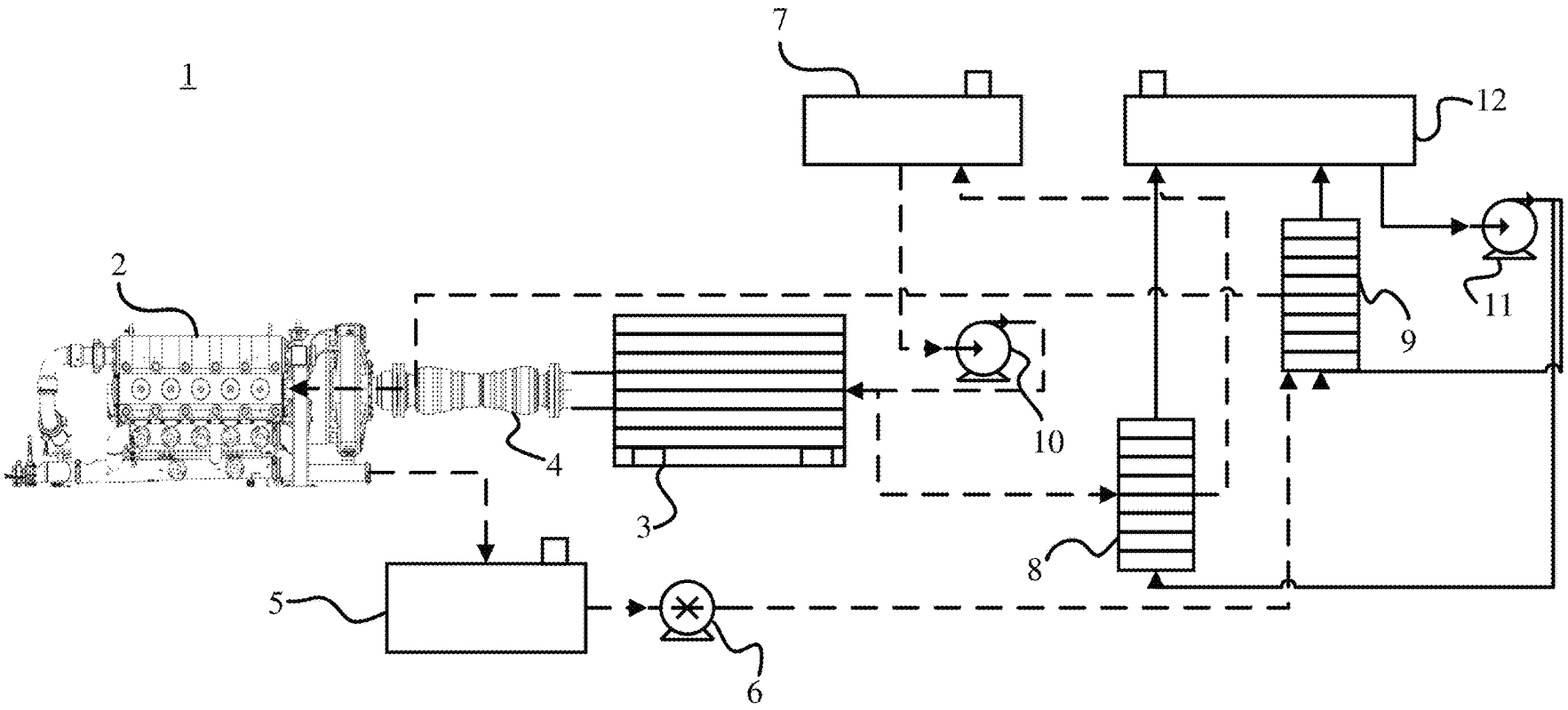
FIG. 2 is a schematic diagram illustrating a liquid-cooling fracturing system according to Embodiment 2 of this application.

FIG. 2 is a schematic diagram illustrating a liquid-cooling fracturing system according to Embodiment 2 of this application. In Embodiment 1, the cooling liquid may be from a natural water source in nature. In Embodiment 2, it can be set that the cooling liquid is not from the natural water source in nature as in Embodiment 1, but from a large man-made container, such as a water tank and a water tower, in which the cooling liquid is stored. Similarly, because the volume of the water tank, water tower or the like is very large, the water storage capacity of the same is naturally very large, so the water that cools the components of the fracturing equipment can also be easily cooled after returning to the cooling liquid source such as the water tank and the water tower, and thus the components of the fracturing equipment can also be cooled through heat exchange between liquid and liquid. In some embodiments, the configuration of the liquid-cooling fracturing system in Embodiment 2 is the same as that in Embodiment 1, and thus is not described repeatedly. In some embodiments, in FIG. 2, components with the same or similar reference numerals as those in FIG. 1 indicate components with the same or similar functions.

In some embodiments, although that seawater can be used as the cooling liquid is mentioned above, it is preferable to use fresh water or the glycol solution as the cooling liquid, which can avoid seawater corrosion and other problems due to water quality problems, thereby improving the reliability of the heat exchange system of the fracturing equipment. Furthermore, the cooling liquid can be recycled in the cooling system of the fracturing equipment, and is cooled by heat exchange with the cooling medium, such as seawater, through an additional heat exchange device.

Embodiment 3

Figure 3:
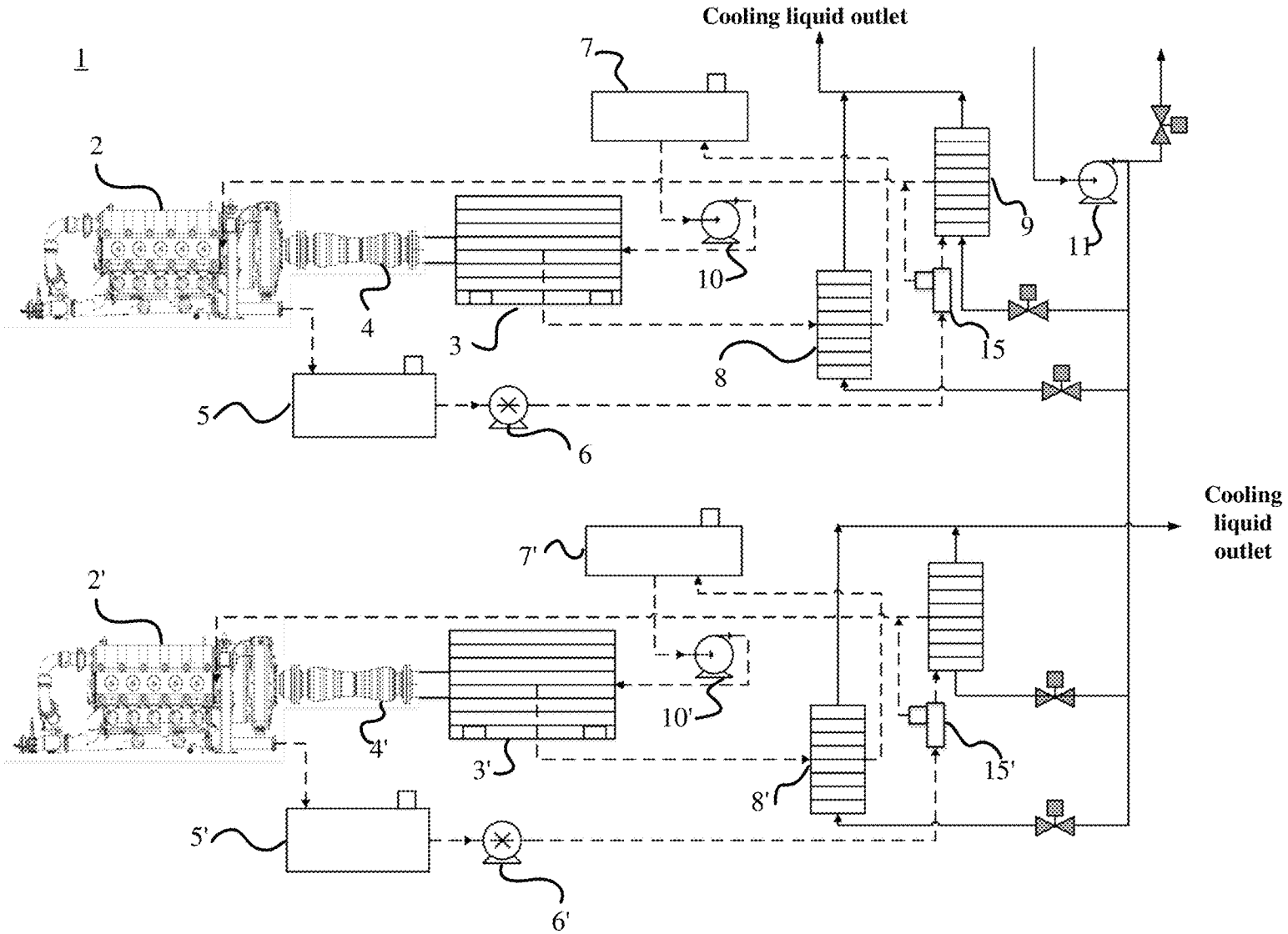
FIG. 3 is a schematic diagram illustrating a liquid-cooling fracturing system according to Embodiment 3 of this application.

FIG. 3 is a schematic diagram illustrating a liquid-cooling fracturing system according to Embodiment 3 of this application. In Embodiment 1 and Embodiment 2 mentioned above, one third pumping device 11 is configured to correspond to one piece of fracturing equipment, that is, one third pumping device 11 is configured to provide cooling liquid for first and second heat exchange devices 8 and 9 of one piece of fracturing equipment, to cool components of the fracturing equipment.

However, in this Embodiment 3, it may also be that one third pumping device 11 may be configured to correspond to a plurality of pieces of fracturing equipment, such as two pieces of fracturing equipment as shown in FIG. 3. That is, one third pumping device 11 is configured to provide cooling liquid for first and second heat exchange devices 8, 8', 9, 9' of the two pieces of fracturing equipment, to cool components of these fracturing equipment. In this case, one third pumping device 11 can provide the cooling liquid for two or more pieces of fracturing equipment, which can improve the cooling efficiency, simplify the structure of the cooling system and reduce the cost. In some embodiments, the configuration of the liquid-cooling fracturing system in Embodiment 3 is the same as that in Embodiment 1, and thus is not described repeatedly. In FIG. 3, components with the same or similar reference numerals as those in FIG. 1 indicate components with the same functions. In some embodiments, a cooling liquid source in Embodiment 3 may also be a large cooling liquid container, such as a water tank and a water tower, as in Embodiment 2.

Embodiment 4

Figure 4:
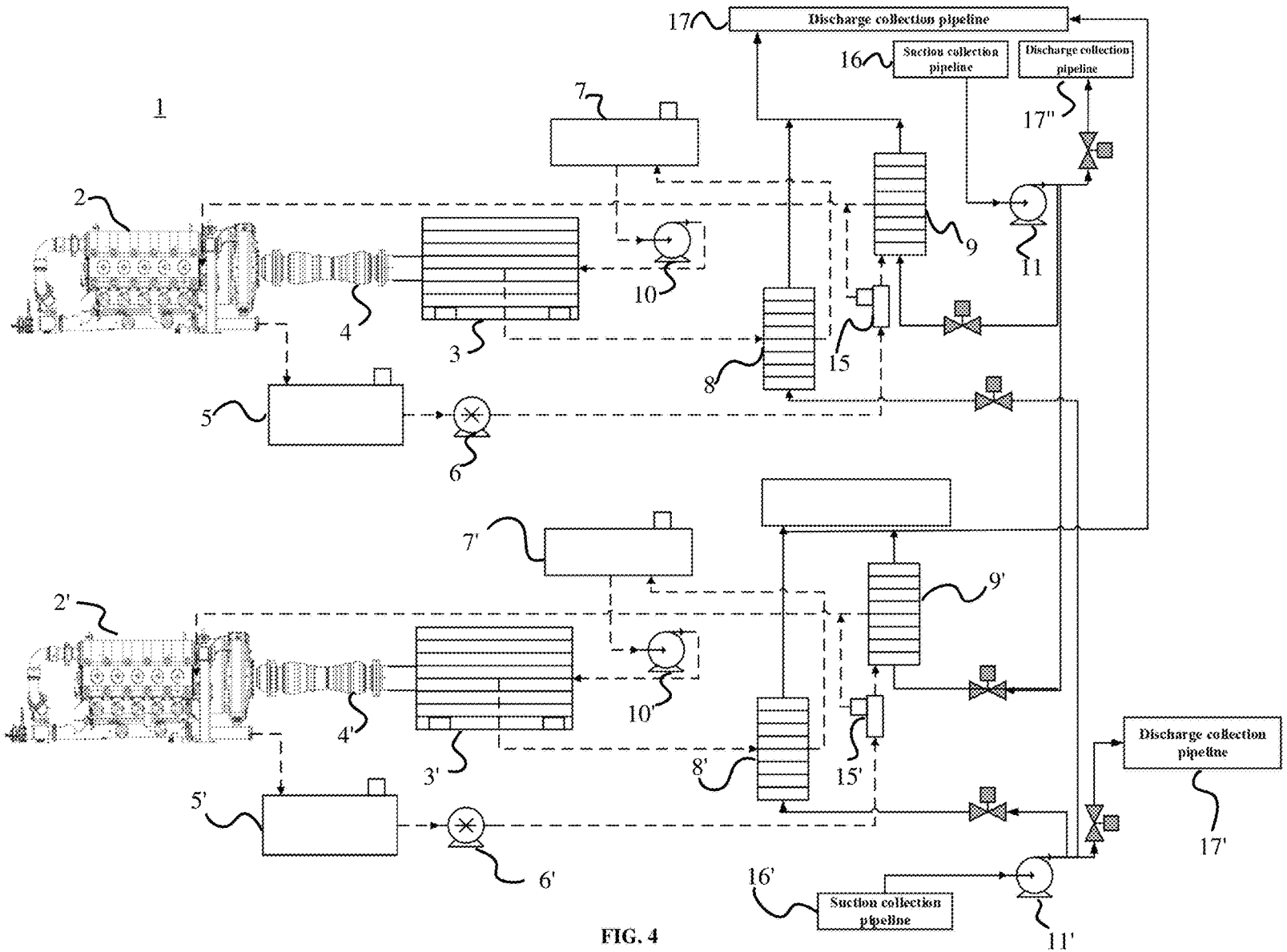
FIG. 4 is a schematic diagram illustrating a liquid-cooling fracturing system according to Embodiment 4 of this application.

FIG. 4 is a schematic diagram illustrating a liquid-cooling fracturing system according to Embodiment 4 of this application. In FIG. 3 of Embodiment 3 mentioned above, one third pumping device 11 is configured to correspond to two pieces of fracturing equipment, to cool the components of these fracturing equipment. However, in Embodiment 4, two third pumping devices 11 and 11' may also be disposed, where one third pumping device 11' is configured to provide cooling for power devices 3 and 3' of the plurality of pieces of fracturing equipment, that is, one third pumping device 11' is configured to provide cooling liquid for first heat exchange devices 8 and 8' of the plurality of pieces of fracturing equipment, and the other third pumping device 11 is configured to provide cooling for lubricating systems of pressure devices 2 and 2' of the plurality of pieces of fracturing equipment, that is, the other third pumping device 11 is configured to provide cooling liquid for second heat exchange devices 9 and 9' of the plurality of pieces of fracturing equipment, to cool the power devices and the lubricating systems of these fracturing equipment. In this Embodiment 4, discharge collection pipelines 17, 17" and 17' and suction collection pipelines 16 and 16' may be disposed, where cooling liquid outlets of first and second heat exchange devices 8, 8', 9, 9' may be connected to the discharge collection pipeline 17, to feed the cooling liquid after heat exchange to the discharge collection pipeline 17, and return the cooling liquid to a cooling liquid source. Discharge holes of the third pumping devices 11 and 11' are respectively connected to the discharge collection pipelines 17" and 17' for the purposes of regulating flow of the cooling liquid entering the first and second heat exchange devices 8, 8', 9, 9' and overflowing, and the suction collection pipes 16 and 16' may be connected between the cooling liquid source and the third pumping device 11 and 11', to pump the cooling liquid in the cooling liquid source to each heat exchange device through the suction collection pipes 16 and 16'. In FIG. 4, although the suction collection pipes 16 and 16' seem to be two pipelines disposed separately, this is only schematic and for the ease of drawing. The suction collection pipes 16 and 16' are the same suction collection pipe connected between the cooling liquid source and the third pumping devices 11 and 11', but connection positions are different. Similarly, the discharge collection pipes 17, 17" and 17' are also the same discharge collecting pipe, but the connection positions are different. Because the lubricating systems of the same types of components, such as the power devices 3 and 3' or the fracturing devices 2 and 2', usually have similar heat dissipation requirements, by making one third pumping device 11 provide cooling for one type of components and the other third pumping device 11' provide cooling for another type of components, the flow of each third pumping device 11, 11' can be accurately controlled, thereby achieving the purpose of effectively controlling the heat exchange efficiency of the various types of components respectively. In this case, different parameters, such as power, can be set for each third pumping device 11, 11' according to the different types of components that actually need to be cooled, so as to realize the optimal design of the third pumping devices 11, 11' and optimize the cost-effectiveness of the whole cooling system. The configuration of the liquid-cooling fracturing system in Embodiment 4 may be the same as that in Embodiment 3, and thus is not described repeatedly.

In FIG. 4, components with the same or similar reference numerals as those in FIG. 3 indicate components with the same or similar functions.

Embodiment 5

Figure 5:
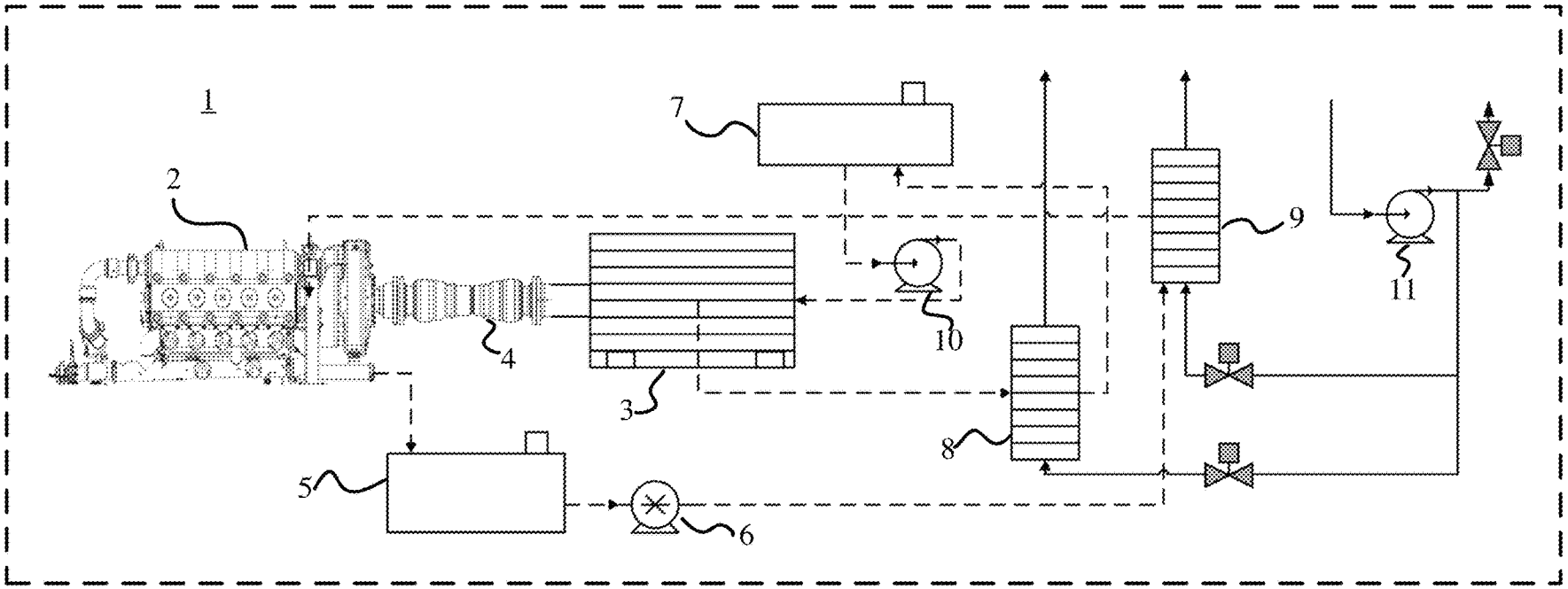
FIG. 5 is a schematic diagram illustrating a liquid-cooling fracturing system according to Embodiment 5 of this application.

FIG. 5 is a schematic diagram illustrating a liquid-cooling fracturing system according to Embodiment 5 of this application. As shown in a dotted box of FIG. 5, components, except a cooling liquid source, of fracturing equipment of a liquid-cooling fracturing system 1 of this application are integrated. That is, the liquid-cooling fracturing equipment composed of the fracturing device 2, the power device 3, the lubricating medium storage device 5, the cooling medium storage device 7, the first and second heat exchange devices 8, 9, the second pumping device 6, the first pumping device 10 and the third pumping device 11 are integrated. That is, the first and second heat exchange devices 8, 9 may be integrated with various components of the fracturing equipment, and may be directly connected to the cooling liquid source when in use. In this case, because the first and second heat exchange devices 8 and 9 are integrated with various components of the fracturing equipment, it is convenient to install and debug the single piece of liquid-cooling fracturing equipment without complicated installation and debugging, thereby simplifying an installation procedure. In FIG. 5, components with the same or similar reference numerals as those in FIG. 1 indicate components with the same or similar functions, and will not be described repeatedly.

Embodiment 6

Figure 6:
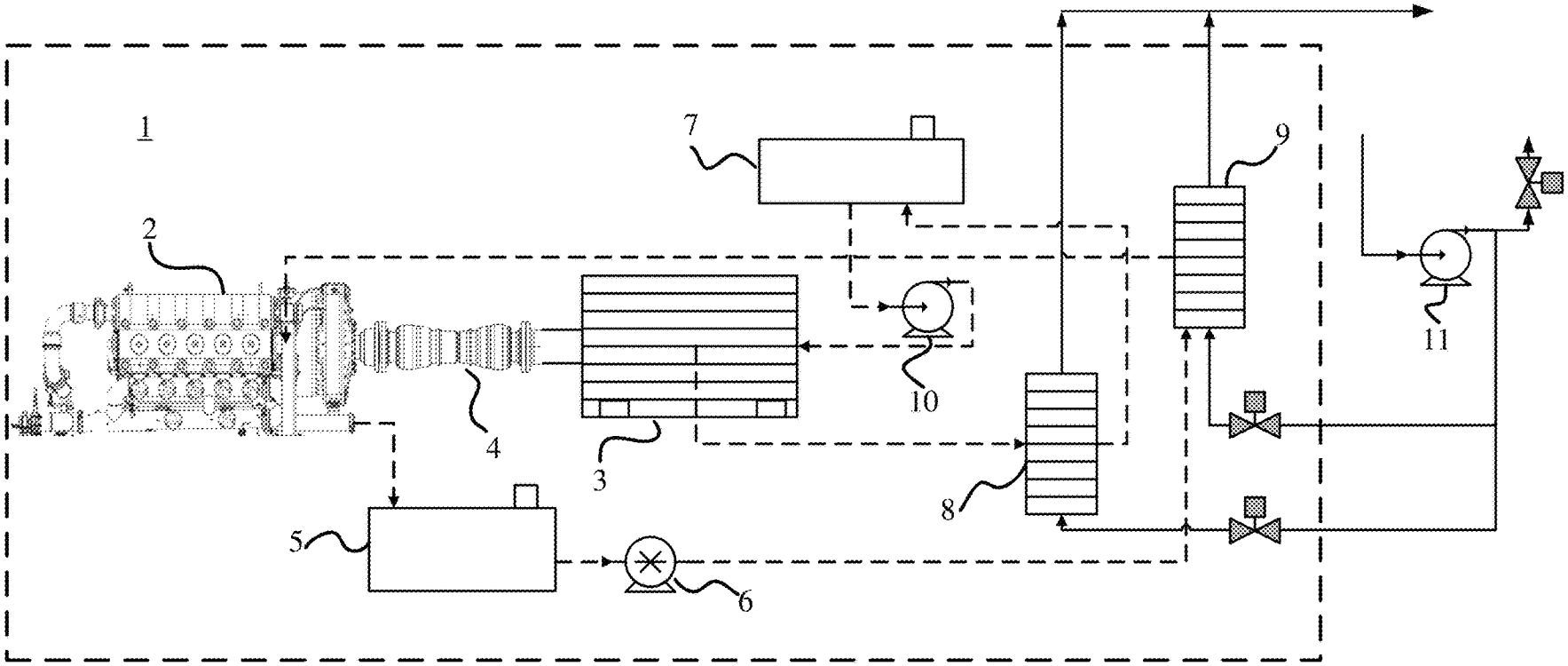
FIG. 6 is a schematic diagram illustrating a liquid-cooling fracturing system according to Embodiment 6 of this application.

FIG. 6 is a schematic diagram illustrating a liquid-cooling fracturing system according to Embodiment 6 of this application. In this Embodiment 6, unlike Embodiment 5, fracturing equipment of this embodiment excludes a third pumping device 11, that is, the fracturing equipment is not integrated with the third pumping device 11, as shown by a dotted box in FIG. 6. In other words, the liquid-cooling fracturing equipment composed of the fracturing device 2, the power device 3, the lubricating medium storage device 5, the cooling medium storage device 7, the first and second heat exchange devices 8, 9, the second pumping device 6 and the first pumping device 10 are integrated, but the third pumping device 11 is disposed separately from the liquid-cooling fracturing equipment. In this case, the various components of the fracturing equipment have a higher degree of design freedom and can be freely configured according to actual needs. The suitable third pumping device 11 is selected for connection when in use. Since there is no need to design a third pumping device 11 for fracturing equipment of various design standards, the cost is saved.

Embodiment 6

Figure 7:
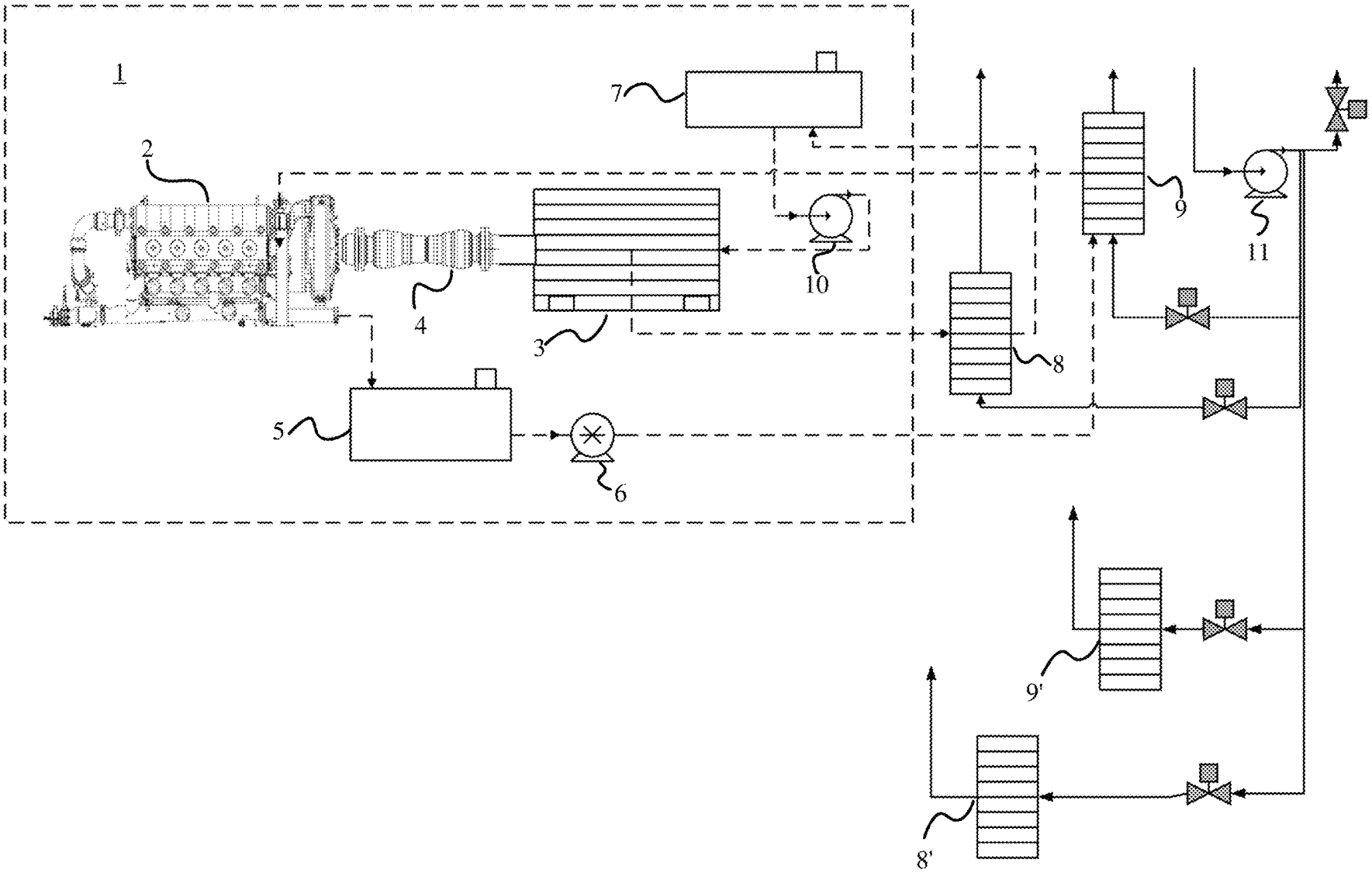
FIG. 7 is a schematic diagram illustrating a liquid-cooling fracturing system according to Embodiment 7 of this application.

FIG. 7 is a schematic diagram illustrating a liquid-cooling fracturing system according to Embodiment 7 of this application. In this embodiment, fracturing equipment is not integrated with first and second heat exchange devices 8, 9 and a third pumping device 11, as shown by a dotted box in FIG. 7. In other words, the liquid-cooling fracturing equipment composed of the fracturing device 2, the power device 3, the lubricating medium storage device 5, the cooling medium storage device 7, the second pumping device 6 and the first pumping device 10 are integrated, but the first and second heat exchange devices 8, 9 and the third pumping device 11 are disposed separately from the liquid-cooling fracturing equipment. In other words, the heat exchange devices may be placed on the periphery of the fracturing equipment or intensively placed in a heat exchange device installation region (that is, not integrated with the equipment), which facilitates integration of an on-site heat exchange system and an equipment installation site, and facilitates unified installation and management of the heat exchange system.

The above is only the preferred embodiments of this application, and are not used to limit this application. It should be noted that in the case of no conflict, the embodiments of this application and the features in the embodiments can be combined with each other. Those skilled in the art can make any modification, substitution and improvement within the spirit and principles of this application, which should be included in the scope of this application.

What is claimed is:

1. A liquid-cooled fracturing system, comprising:

a fracturing device;

a power device connected to the fracturing device through a transmission device and configured to provide power for the fracturing device;

a cooling medium storage device, configured to store a cooling medium used for cooling the power device;

a lubricating system comprising a lubricating medium storage device, the lubricating medium storage device being configured to store a lubricating medium for lubricating the fracturing device;

a first heat exchange device, the first heat exchange device using cooling liquid to exchange heat with the cooling medium to cool the cooling medium;

a second heat exchange device using the cooling liquid to exchange heat with the lubricating medium to cool the lubricating medium;

a first pumping device configured to circulate the cooling medium between the cooling medium storage device, the power device, and the first heat exchange device;

a second pumping device configured to circulate the lubricating medium between the lubricating medium storage device, the second heat exchange device, and the fracturing device; and a thermostat disposed on an outlet pipeline of the second pumping device.

2. The liquid-cooled fracturing system according to claim 1, further comprising:

a cooling liquid source, configured to provide the cooling liquid; and a third pumping device, configured to direct the cooling liquid to flow from the cooling liquid source into the first heat exchange device and/or into the second heat exchange device, to exchange heat with the cooling medium and/or the lubricating medium at the first heat exchange device and/or the second heat exchange device, and return the cooling liquid to the cooling liquid source after heat exchange.

3. The liquid-cooled fracturing system according to claim 2, further comprising:

a first flow pipeline, through which the cooling medium circulates between the cooling medium storage device, the power device, and the first heat exchange device;

a second flow pipeline, through which the lubricating medium circulates between the lubricating medium storage device, the second heat exchange device, and the fracturing device; and a third flow pipeline, through which the cooling liquid flows from the cooling liquid source into the first and second heat exchange devices and returns to the cooling liquid source after heat exchange.

4. The liquid-cooled fracturing system according to claim 1, wherein the cooling liquid has heat exchange capacity.

5. The liquid-cooled fracturing system according to claim 2, wherein the cooling liquid source is a natural or man-made container storing the cooling liquid, wherein an amount of the cooling liquid in the cooling liquid source is greater than an amount of the cooling liquid for cooling the cooling medium and the lubricating medium.

6. The liquid-cooled fracturing system according to claim 1, further comprising a filtering device disposed on an outlet pipeline of the lubricating medium storage device, to filter out solid impurities in the lubricating medium.

7. The liquid-cooled fracturing system according to claim 2, further comprising one or more flow regulating devices disposed on cooling liquid inlet pipelines or cooling liquid outlet pipelines of the first and second heat exchange devices, to regulate flow of the cooling liquid flowing through the first and second heat exchange devices.

8. The liquid-cooled fracturing system according to claim 1, further comprising:

one or more pressure sensors disposed on outlet pipelines of the first pumping device and the second pumping device to measure pressures in the pipelines, and one or more safety valves disposed on the outlet pipelines of the first pumping device and the second pumping device, the one or more safety valves being configured to regulate pressure in the pipelines based on a measurement result of the one or more pressure sensors.

9. The liquid-cooled fracturing system according to claim 2, further comprising one or more temperature sensors disposed on inlet pipelines or outlet pipelines of the first pumping device, the second pumping device, and the third pumping device, to measure a temperature of liquid flowing in the pipelines.

10. The liquid-cooled fracturing system according to claim 2, further comprising a pressure sensor disposed on an outlet pipeline of the third pumping device to measure a pressure in the outlet pipeline of the third pumping device.

11. The liquid-cooled fracturing system according to claim 2, further comprising a flowmeter disposed on an outlet pipeline of the third pumping device to measure flow of liquid flowing in the outlet pipeline of the third pumping device.

12. The liquid-cooled fracturing system according to claim 9, further comprising a control system configured to automatically control a flow of the third pumping device according to a temperature measured by the one or more temperature sensors.

13. The liquid-cooled fracturing system according to claim 10, further comprising a control system configured to automatically control the third pumping device to keep the pressure measured by the pressure sensor constant.

14. The liquid-cooled fracturing system according to claim 11, further comprising a control system configured to automatically control the third pumping device to keep the flow measured by the flowmeter constant.

* * * * *